US008836203B2

(12) United States Patent
Nobles et al.

(10) Patent No.: US 8,836,203 B2
(45) Date of Patent: Sep. 16, 2014

(54) SIGNAL RETURN FOR ULTRASONIC TRANSDUCERS

(75) Inventors: Brent Michael Nobles, Chapel Hill, NC (US); Minoru Toda, Lawrenceville, NJ (US); Mitchell L. Thompson, Exton, PA (US); Edward P. Harhen, Duxbury, MA (US)

(73) Assignee: Measurement Specialties, Inc., Hampton, VA (US)

( * ) Notice: Subject to any disclaimer, the term of this patent is extended or adjusted under 35 U.S.C. 154(b) by 95 days.

(21) Appl. No.: 13/436,434

(22) Filed: Mar. 30, 2012

(65) Prior Publication Data

US 2013/0257226 A1 Oct. 3, 2013

(51) Int. Cl.
*H04R 17/00* (2006.01)

(52) U.S. Cl.
USPC ..... 310/334; 310/327

(58) Field of Classification Search
USPC ..... 310/334, 335, 337, 327, 336, 322; 600/459
See application file for complete search history.

(56) References Cited

U.S. PATENT DOCUMENTS

| | | | | |
|---|---|---|---|---|
| 4,825,115 | A * | 4/1989 | Kawabe et al. | 310/327 |
| 8,330,333 | B2 * | 12/2012 | Harhen et al. | 310/334 |
| 2004/0095045 | A1 * | 5/2004 | Baumgartner | 310/365 |
| 2010/0241003 | A1 * | 9/2010 | Jung et al. | 310/327 |
| 2011/0050039 | A1 | 3/2011 | Toda et al. | |

* cited by examiner

*Primary Examiner* — Thomas Dougherty
*Assistant Examiner* — Karen B Addison
(74) *Attorney, Agent, or Firm* — Howard IP Law Group, PC

(57) ABSTRACT

A transducer useful for medical imaging ultrasonic transducers comprises a front impedance matching layer, a piezoelectric array, and a rear layer. The front impedance matching layer may include a return connection region electrically coupled to a distal end of the piezoelectric array and a front metal layer with a return signal portion for routing the return signal from the distal end of the transducer to a flex circuit of the rear layer at a proximal end of the transducer. In an embodiment, the rear layer may include a return connection region that is electrically coupled to the piezoelectric array at a distal end of the transducer and also electrically coupled to the signal return lines of a flex circuit at the distal end of the transducer.

20 Claims, 9 Drawing Sheets

SIGNAL RETURN FOR ULTRASONIC TRANSDUCERS

FIELD OF THE INVENTION

The present invention generally relates to ultrasonic transducers and methods for fabricating signal return lines for same.

BACKGROUND OF THE INVENTION

Ultrasonic transducers are often used as impulse mode transducers operating over a wide range of frequencies. Since such transducers need to handle wideband frequency signals, wideband design is an important subject. In the prior art, impedance converters (also known as impedance matching layers) have been placed on a face of a piezoelectric element or piezoelectric active layer (also called a "piezoelectric array" herein) of an ultrasonic transducer to improve the wideband frequency response of the transducer. One of the important applications of wideband transducers is in medical imaging systems. Economical, reliable and reproducible mass-production processes for transducers for use in medical imaging systems are particularly desirable.

Impedance converters for ultrasonic transducers are known in the art. As is known in the art, an ultrasonic transducer includes a piezoelectric active layer, one or more front matching layers on a front face of the piezoelectric active layer to serve as an impedance converter, and a backing absorber on a rear face of the piezoelectric active layer. A typical piezoelectric material, such as lead zirconate titanate has high characteristic acoustic impedance, for example, $Z_{piezoelectric\ array}=30\times10^6$ kg/m$^2$s (Rayl). A typical propagation medium, such as water, has low characteristic acoustic impedance, for example, $Z_R=1.5\times10^6$ Rayl. Because of the difference in characteristic acoustic impedances of these media, acoustic waves in the piezoelectric active layer of an ultrasonic transducer are reflected backward into the piezoelectric active layer at the boundary between the piezoelectric active layer and the transmission medium (the front boundary) and reflected frontward into the piezoelectric active layer at the back boundary (the boundary between the rear face of the piezoelectric active layer and the material to the rear of the piezoelectric active layer). This results in a resonance at a specific frequency in the ultrasonic transducer, as determined by the half wavelength condition of the piezoelectric material.

When such a resonated transducer is driven by a voltage pulse (when acting as a transmitter) or by an acoustic pulse (when acting as a receiver), the signal wave does not decay quickly (a phenomenon known as ringing). This effectively renders such a transducer unsuitable for imaging systems, in which systems short acoustic pulse beams are excited, directionally scanned and reflected back from a target to enable an image of the target to be constructed. A front impedance conversion layer (also known in the art as a matching layer for reducing reflections) is inserted between the front face of the piezoelectric layer and the propagation medium to mitigate creation of resonance due to the difference in the characteristic acoustic impedances of the piezoelectric material and the front propagation medium.

A piezoelectric layer's vibration excites an acoustic wave in the backward direction, i.e., in a direction away from the front face of the piezoelectric layer. A certain amount of reflection from the back boundary towards the front face may be desirable to improve the sensitivity of the ultrasonic transducer. Often a backing absorber layer of acoustic absorber material is attached to the rear face of the piezoelectric layer. If the characteristic acoustic impedance of the backing absorber material effectively matches that of the piezoelectric material, a significant amount of acoustic wave energy passes through the back boundary without reflection and is absorbed by the backing absorber layer. In such a case, the sensitivity of the transducer is lowered and the bandwidth may become excessive for some applications. Therefore, some mismatch between the characteristic acoustic impedance of the piezoelectric material and the backing absorber material is desirable, depending on the required bandwidth and sensitivity.

The characteristic acoustic impedance of the backing absorber material may be selected to obtain a desired performance of the ultrasonic transducer. If a transducer cannot be provided with a backing absorber material of a suitable characteristic acoustic impedance, a back impedance conversion layer may be added between the piezoelectric active layer and the backing absorber layer to provide a desired overall acoustic impedance at the back boundary of the piezoelectric layer.

A typical acoustic impedance conversion structure may be a layer of uniform thickness, the thickness equal to about one-quarter of the wavelength of a desired operating wavelength of the acoustic transducer. Another known acoustic impedance conversion structure providing still wider bandwidth uses double matching layers. It is quite difficult to obtain appropriate materials for these layers while satisfying the specific designed values of the characteristic acoustic impedances. A suitable structure is described in U.S. Patent Publication No. 2011/0050039 to Toda, et al., which is fully incorporated by reference herein.

A problem associated with the conventional design of ultrasonic transducers arises in the design of the structure for the transducer return signal. The prior art structure for routing the transducer return signal typically involves painstaking labor to connect the piezoelectric/polymer array to the return lines. Furthermore, because piezoelectric materials are temperature sensitive, conventional methods to make electrical connections like solder cannot be used to create the return signal paths. Thus, the prior art method of creating a return signal path is both difficult and labor intensive.

SUMMARY OF THE INVENTION

According to an embodiment of the present invention, an ultrasonic transducer comprises a piezoelectric element, a front impedance matching layer, and a rear acoustic impedance converter. In an embodiment, the invention integrates a signal return structure into the front impedance converter to return signals from the transducer. In another embodiment, the invention integrates the signal return structure into the rear layer to return signals from the transducer. These embodiments reduce the labor costs associated with the prior art signal return structure.

Specifically, an ultrasonic transducer with a signal return in the front impedance matching layer may comprise: a rear layer including a including a flex circuit layer and a backing absorber layer adjacent to the flex circuit layer; a piezoelectric element coupled on a first side to the flex circuit layer; and a front impedance matching layer including a front metal layer comprising a connection region portion at the distal end of the transducer and a signal return portion electrically coupled to the connection region portion and extending from the distal end to the proximal end of the transducer. The front impedance matching layer is coupled to a second side of the piezoelectric element, thereby causing the connection region portion of the front metal layer to make electrical contact with the piezoelectric element; and a proximal end of the signal return portion of the front metal layer is electrically coupled to a signal return conductor of the flex circuit layer at the proximal end of the transducer, thereby completing a return circuit. In an embodiment, the front impedance matching layer further comprises a front polymer layer adjacent to a first side of the front metal layer and a back polymer layer adjacent to a second side of the front metal layer, wherein the back polymer layer is coupled to the second side of the piezoelectric element, thereby coupling the connection region portion with the piezoelectric element. The back polymer layer may be shorter than the front metal layer at a distal end of the transducer, thereby exposing the connection region portion for coupling to the piezoelectric element.

An embodiment of the transducer may include shielding. Specifically, the flex circuit layer may comprise a shielded portion at a proximal end of the transducer and a non-shielded portion at a distal end of the transducer. In this embodiment the piezoelectric element is coupled to the non-shielded portion of the flex circuit layer; the front metal layer further comprises a shield portion electrically isolated from the connection region portion and the signal return portion, and the shield portion of the front metal layer is electrically coupled to the shielded portion of the flex circuit layer at the proximal end of the transducer. The front metal layer may further comprise front metal layer signal return pads and front metal layer shield pads at the proximal end of the transducer, the shield layer of the rear layer may further comprises shield layer pads at the proximal end of the transducer, and the flex circuit layer of the rear layer may further comprise flex circuit layer signal return pads at the proximal end of the transducer. In this embodiment, the signal return portion of the front metal layer is electrically coupled to a signal return conductor of the flex circuit layer via the front metal layer signal return pads and the flex circuit layer signal return pads and the shield portion of the front metal layer is electrically coupled to the shield layer of the rear layer via the front metal layer shield pads and the shield layer pads.

In an embodiment of the transducer with the signal return in the front impedance matching layer, the back polymer layer may be shorter than the front metal layer and the front polymer layer on a proximal end of the transducer, and the transducer may further comprise an insulator element between the front metal layer and the flex circuit layer for preventing unintended electrical coupling between the front metal layer and the flex circuit layer. The transducer may further comprise a conductive layer between the piezoelectric element and the connection region for electrically coupling the piezoelectric element with the connection region. In addition, the transducer may further comprise a backing absorber layer coupled to a second side of the flex circuit layer.

A method for forming an ultrasonic transducer with a signal return in the front impedance matching layer may comprise the steps of: providing a rear layer including a flex circuit layer; disposing a first side of a piezoelectric element onto a first side of the flex circuit layer of the rear layer; dicing the piezoelectric element; disposing a front impedance matching layer onto a second side of the piezoelectric element, wherein the front impedance matching layer includes a front metal layer having a connection region portion and a signal return portion, the connection region portion being electrically coupled to the front metal layer when the front impedance matching layer is disposed onto the second side of the piezoelectric element; and electrically coupling a proximal end of the signal return portion with a return signal line portion of the flex circuit layer, thereby completing a return circuit for the transducer. In the method for constructing a transducer, the front impedance matching layer may further comprise a front polymer layer adjacent to a first side of the front metal layer and a back polymer layer adjacent to a second side of the front metal layer, and wherein disposing the front impedance matching layer onto the piezoelectric element may comprise disposing the back polymer layer onto the second side of the piezoelectric element and thereby electrically coupling the connection region portion with the piezoelectric element. In an embodiment, the back polymer layer may be shorter than the front metal layer at a distal end of the transducer, thereby exposing the connection region portion for coupling to the piezoelectric element.

In another embodiment, the flex circuit layer may comprise a shielded portion at a proximal end of the transducer and a non-shielded portion at a distal end of the transducer, and disposing a first side of a piezoelectric element onto a first side of the flex circuit layer of the rear layer comprises disposing the piezoelectric element onto the non-shielded portion of the flex circuit layer. The front metal layer may further comprise a shield portion electrically isolated from the connection region portion and the signal return portion and the method may further comprise electrically coupling the shield portion of the front metal layer to the shielded portion of the flex circuit layer at the proximal end of the transducer. In other embodiment, electrically coupling the signal return portion of the front metal layer to the return signal portion of the flex circuit layer comprises disposing the front impedance matching layer on the piezoelectric element such that front metal layer signal return pads of the front metal layer are in electrical contact with rear layer signal return pads of the rear layer. Electrically coupling the shield portion of the front metal layer and the shielded portion of the flex circuit layer of the rear layer comprises disposing the front impedance matching layer on the piezoelectric element such that shield pads of the front metal layer are in electrical contact with rear layer shield pads of the shielded portion of the flex circuit layer.

In an embodiment, the back polymer layer is shorter than the front metal layer and the front polymer layer on a proximal end of the transducer, and the method for constructing the transducer includes disposing an insulator element between the front metal layer and the flex circuit layer for preventing unintended electrical coupling between the front metal layer and the flex circuit layer. In an embodiment, the method may further comprise disposing a conductive layer between the piezoelectric element and the connection region portion for electrically coupling the piezoelectric array with the connection region. The method may also comprise coupling a backing absorber layer to a second side of the flex circuit layer.

An ultrasonic transducer with a signal return in the rear layer may comprise: a piezoelectric element; a folded layer comprising a rear layer portion including a flex circuit layer and a rear copper layer adjacent to a first side of the flex circuit layer. The rear copper layer may have a signal lines portion, a connection region portion, and signal return lines. The ultrasonic transducer may also comprise a front impedance matching layer portion, wherein the front impedance matching layer portion and the connection region portion of the rear copper layer are coupled to a first side of the piezoelectric element; wherein the signal lines portion of the rear copper layer of the rear layer portion are coupled to the second side of the piezoelectric element; and wherein the signal return lines of the rear copper layer electrically couple the connection region portion to signal return conductors of the flex circuit layer, thereby creating a signal return.

In an embodiment, the flex circuit layer in the ultrasonic transducer with a signal return in the rear layer portion may include a shielded portion and a non-shielded portion, and the rear copper layer may be adjacent to the non-shielded portion of the flex circuit layer. In this embodiment, a front metal layer of the front impedance matching layer is electrically coupled to the shielded portion of the flex circuit layer at a proximal end of the ultrasonic transducer. The front impedance matching layer portion of the transducer may further comprise a front polymer layer adjacent to a first side of the front metal layer and a back polymer layer adjacent to a second side of the front metal layer, in which case the front impedance matching layer portion being coupled to the first side of the piezoelectric element comprises the back polymer layer being coupled to the first side of the piezoelectric element. In an embodiment, the back polymer layer may be shorter than the front metal layer and the front shield layer, thereby exposing the front metal layer for electrical coupling to the shielded portion of the flex circuit layer. In another embodiment, the front polymer layer may be comprised of the flex circuit layer of the rear layer portion.

The transducer with the signal return in a rear layer portion may also comprise a conductive layer between the second side of the piezoelectric and the connection region for electrically coupling the piezoelectric element with the connection region. In an embodiment of the ultrasonic transducer, the signal lines portion of the rear copper layer is offset from the connection region portion of the rear copper layer and the signal return lines are on outer edges of the rear copper layer, thereby forming an opening in the rear copper layer, the opening being collocated with a distal end of the piezoelectric element and preventing the rear copper layer from making unintended electrical contact with the piezoelectric element. The ultrasonic transducer may further comprise a backing absorber layer coupled to a second side of the flex circuit layer.

A transducer with a signal return in the rear layer portion may be constructed by providing a folding layer including a rear layer portion comprising a rear copper layer including a main portion, a connection region portion, and signal return lines and a flex circuit layer including flex signal return lines coupled to the rear copper layer; and a front impedance matching layer portion. After the folding layer is provided, a first side of a piezoelectric element is disposed onto the main portion of the rear copper layer. Then the piezoelectric element is diced, thereby creating a piezoelectric array. The dicing is configured to also penetrate the main portion of the rear copper layer beneath the piezoelectric array, thereby forming individual copper signal lines or strips that correspond to piezoelectric array elements and also forming signal return line strips, the signal return line strips being electrically connected to the connection region portion and to the flex signal return lines. Then the front impedance matching layer portion and the connection region portion of the folding layer are folded onto the piezoelectric array, which results in the front impedance matching layer portion and the the connection region portion being coupled to the piezoelectric array. This creates a signal return path for the piezoelectric array via the connection region and the signal return lines electrically connected to the flex layer signal return lines.

In the method for constructing the transducer with a signal return in the rear layer portion, the flex circuit layer may include a shielded portion and a non-shielded portion. In this embodiment, the rear copper layer is adjacent or coupled to the non-shielded portion of the flex circuit layer. A front metal layer of the front impedance matching layer may be electrically coupled to shielded portion of the flex circuit layer at a proximal end of the ultrasonic transducer. The front impedance matching layer may further comprise a front polymer layer adjacent to a first side of the front metal layer and a back polymer layer adjacent to a second side of the front metal layer. In this embodiment, folding the front impedance matching layer portion onto a second side of the piezoelectric element comprises folding the back polymer layer onto the second side of the piezoelectric element. The embodiment may also comprise shortening the back polymer layer so that it is shorter than the front metal layer and the front polymer layer, thereby exposing the front metal layer for electrical coupling to the shielded portion of the flex circuit layer. In an embodiment, the front polymer layer of the front impedance matching layer may be comprised of the flex circuit layer of the rear layer portion. The method for constructing the transducer may also comprise applying silver epoxy to the back polymer layer of the front impedance matching layer before folding, thereby causing the front impedance matching layer to bond to the piezoelectric array after folding. Silver epoxy may also be applied to the connection region before folding, thereby causing the connection region to bond to the piezoelectric array after folding. In an embodiment, before dicing the piezoelectric element, the front impedance matching layer portion may be bent downward so that it is below the planar surface formed by the rear layer portion of the folding layer, thereby preventing the front impedance matching layer portion from being diced.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF THE DRAWINGS

Figure 1:
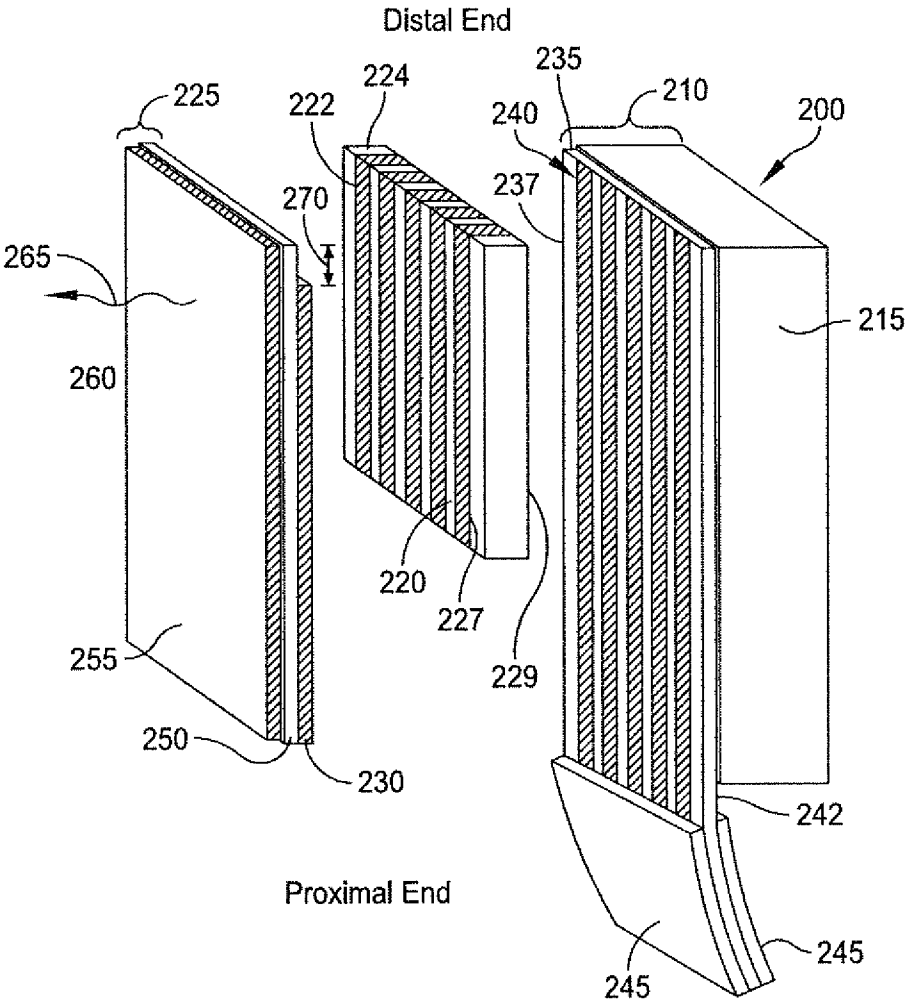
FIG. 1 is a schematic perspective view of a transducer according to an embodiment of the invention in which the signal return connection to the flex circuit is on the proximal end of the transducer.

Reference will now be made to various embodiments of the invention, examples of which are illustrated in the accompanying drawings. Wherever possible, the same reference numbers will be used throughout the drawings to refer to the same or like parts. It is to be understood that the figures and descriptions of the present invention have been simplified to illustrate elements that are relevant for a clear understanding of the present invention, while eliminating, for purposes of clarity, many other elements found in typical ultrasonic transducers. Because such elements are well known in the art, and because they do not facilitate a better understanding of the present invention, a discussion of such elements is not provided herein. The disclosure herein is directed to all such variations and modifications known to those skilled in the art.

In addition, this description of the preferred embodiments is intended to be read in connection with the accompanying drawings, which are to be considered part of the entire written description of this invention. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

As disclosed in U.S. Patent Publication No. 2011/0050039 to Toda, et al., which is fully incorporated by reference herein, ultrasonic transducers using a metal layer and polymer layer for impedance matching can overcome the disadvantages of overly thick impedance matching designs of the prior art that use a layer of low characteristic impedance material such as aerogels or plastic foams, or pure polymer and/or polymer loaded with powder and/or fibers for use in medical applications. At least some of the drawbacks associated with prior art transducers are addressed in an embodiment wherein a transducer includes a piezoelectric element, a polymer layer disposed on the piezoelectric element, and a metal layer is disposed on the polymer layer. The polymer layer and the metal layer together constitute an impedance converter. As described in Toda, the thicknesses of the polymer layer and the metal layer are selected to provide the impedance converter with an effective characteristic acoustic impedance intermediate the characteristic acoustic impedances of the piezoelectric element and of the propagation medium. Advantageously, by selecting the thicknesses of the metal and polymer layer, a range of effective characteristic acoustic impedances is available. The thickness of this impedance converter may be configured to be much less than one quarter of the wavelength of the target frequencies of the acoustic signals.

Advantageously, an impedance converter having a desired characteristic acoustic impedance can readily be fabricated from commercially available metal and polymer materials, thereby facilitating mass production of impedance converters and reducing costs of production compared to prior art matching layers. Good performance over a broadband range around the center resonant frequency may be obtained, so that a transducer with an impedance converter according to the invention is suitable for applications, such as medical imaging, requiring good broadband performance.

A problem associated with the conventional design of ultrasonic transducers arises in the design of the path for the transducer return signal. The prior art structure for routing the transducer return signal typically involves painstaking labor to connect the piezoelectric/polymer array to the return lines. A design in which the return line is integrated into either a front impedance converter or a rear layer addresses many of the problems of the prior art.

FIG. 1 depicts a side view of a transducer 200 according to an embodiment of the invention. Ultrasonic transducer 200 has a rear layer 210 comprising a flex circuit layer 235 and backing absorber 215 according to an embodiment of the invention. As disclosed in Toda, the desired characteristic acoustic impedance of a backing absorber 215 may vary depending on the material and structure of the piezoelectric active layer. Examples of active piezoelectric layers include bulk piezoelectric ceramic, 2-2 composite, 1-3 composite and single crystals. The desirable characteristic acoustic impedance of backing absorber 215 may differ depending on the particular structures and materials used.

As shown in the exploded view of FIG. 1, transducer 200 includes a piezoelectric array/polymer 2-2 connectivity composite array 220, a front acoustic impedance converter 225 attached (e.g. bonded) to a front surface 227 of array 220 via a back polymer layer 230, a flexible circuit layer 235 with conductor traces 240 (e.g., copper), and a backing absorber 215. Backing absorber 215 is attached (e.g. bonded) to a back surface 229 of array 220 with a non-conductive adhesive, through conductive flexible circuit layer 235 and conductor traces 240. Flexible circuit layer 235 serves to provide a route for electrical signals and also may, in an embodiment, function as part of a back acoustic impedance converter that includes the polymer of the flexible circuit layer 235 and a metal shielding conductive layer (not shown) between the flexible circuit layer and the backing absorber to up-convert the low characteristic acoustic impedance of backing absorber 215.

Composite array 220 includes multiple narrow elongated elements 224 (for example, about 10 millimeters (mm)×0.1 mm) of piezoelectric array with kerfs or channels 222 (for example, of about 50 micrometers (μm) width) therebetween filled with a polymer, such as epoxy. Each piezoelectric array element 224 of composite piezoelectric array 220 may be driven with different signals having different phases to steer beam direction. Composite array 220 is bonded to conductive traces 240. Backside electrodes (not shown) of composite array 220 are connected to conductive traces 240 of flexible circuit layer 235, along a first surface 237 of flexible circuit layer 235. The flexible circuit layer 235 is coupled along a second surface 242 thereof, opposite to first surface 229, to backing absorber 215. Dimensions and materials used for the various layers are disclosed in Toda. Shields 245 may be bonded to either side of the flexible circuit layer 235 at the proximal end of the transducer. The shields are metal layers that help reduce noise picked up by the transducer.

In the illustrated embodiment of FIG. 1, polymer layer 255 of front acoustic impedance converter 225 may be of polyimide and metal layer 250 may be of copper. The thickness of copper layer 250 may be so selected as to provide an appropriate acoustic impedance conversion. It will be understood that piezoelectric array composite array 220, front matching or acoustic impedance converter 225 and the rear layer 210 are shown separately (i.e., not bonded or otherwise coupled) for illustrative purposes only.

In an embodiment, the rear layer may be a specific type of rear impedance matching layer that includes a metal layer (not shown) between the flex circuit layer (which acts as a polymer layer) and the backing absorber layer. In that embodiment, the acoustic impedance between piezoelectric array 220 and backing absorber 215 may be configured as needed. The desired effective acoustic impedance $Z_C$ of may be selected to be consistent with the desired bandwidth and sensitivity of transducer 200. Appropriate materials and thicknesses $t_m$, $t_p$ may be selected for a metal layer and a polymer layer interposed between an active piezoelectric element 224 and a backing absorber 215. The appropriate materials may effectively comprise a back acoustic impedance converter that converts the low characteristic acoustic impedance $Z_1$ of backing absorber 215 to a higher specific acoustic impedance $Z_2$ which is the wave impedance or specific impedance as seen from active piezoelectric array 220 to the interior of backing absorber 215. An appropriate value for specific acoustic impedance $Z_2$ is determined from the desired bandwidth and sensitivity of transducer 200. The thickness of a selected metal layer may be determined based on the desired effective characteristic acoustic impedance $Z_C$ of back acoustic impedance converter, the density of the metal of metal layer 245, and the center resonant frequency $f_o$ of transducer 200. The thickness $t_p$ of a selected polymer layer may be calculated based on the desired effective characteristic acoustic impedance $Z_C$, the density of the polymer of polymer layer 235, the acoustic velocity in the polymer of polymer layer 235, and the center resonant frequency $f_0$ of transducer 200. Toda, which is fully incorporated herein, discloses the calculations necessary to determine the thickness of all of the layers of an embodiment in which the transducer includes a rear impedance matching layer.

Figure 2:
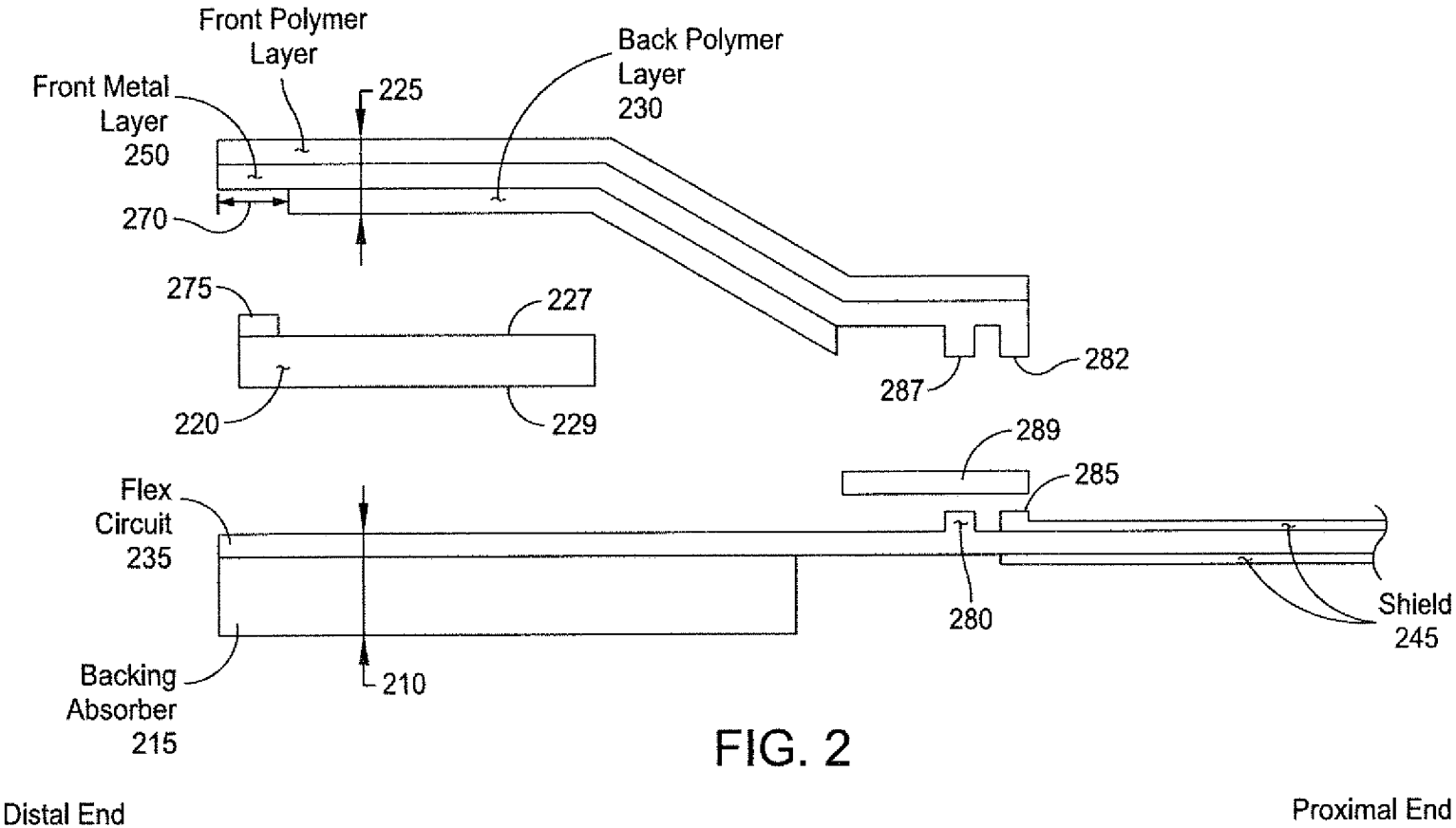
FIG. 2 is a side view of the transducer according to an embodiment of the invention in which the signal return connection to the flex circuit is on the proximal end of the transducer.

FIG. 2 depicts a notional side view of a transducer according to an embodiment of the invention. Transducer 200 includes front impedance converter 225, piezoelectric array 220, and rear layer 210. As used herein, the term piezoelectric array and piezoelectric element may be used to describe both an undiced and diced piezoelectric piece or layer. As disclosed in Toda, the desired characteristic acoustic impedance of a backing absorber 215 may vary depending on the material and structure of the active piezoelectric layer.

Piezoelectric array 220 includes a conductive layer or strip 275 (e.g., anisotropic conductive film or ACF, solder, conductive epoxy/ink) that runs across the width of the piezoelectric array 220 (as shown on FIG. 5A) and which is electrically connected to all of the topside (or frontside) electrodes of the piezoelectric array. The strip establishes a common return signal path for the elements of piezoelectric array 220 and may be a conductive material that creates an electrical connection between the top of the piezoelectric elements and the connection region of the front metal layer, which is the portion of the front metal layer that makes contact with the piezoelectric array through the conductive layer or strip 275. In another embodiment the strip may be nonconductive and may merely bond the connection region to the top of the piezoelectric element; if the strip is thin enough and the diced piezoelectric element has a rough surface, electrical connections between the connection region and the top of the piezoelectric elements may be created by bringing those elements in contact with each other and then bonding them together. Front impedance converter 225 includes front polymer layer 255, front metal layer 250, and back polymer layer 230. Front metal layer 250 is used to form return paths 290 (shown in FIG. 4) and a separate shield area 292. These two separate areas of front metal layer 250 are created by including a space 294 between the front polymer layer 255 and back polymer layer 230 in which there is no metal, as shown in FIG. 4. Front impedance converter 225 also includes a connection region 270 at the distal end of the transducer. The connection region is electrically coupled to strip 275 and also electrically coupled to signal return bars 290 (shown in FIGS. 3 and 4) that carry the return signal back to the signal return pad 280 on the rear layer 210. Element 289 is an insulator element that prevents direct contact between the flex circuit 235 and the front metal layer 250, except for in the areas of the shield pads and signal return line pads.

As shown in FIG. 2, the rear layer may include shield layers 245 above and below the flex circuit layer 235, at the proximal end of the transducer. In the embodiment of FIG. 2, the shield layers do not extend under the piezoelectric array 220, although in another embodiment they may. The shield layers 245 are electrically connected to each other through copper pads on the top and bottom of the flex circuit layer 235 that are electrically connected, and the upper shield layer (the shield layer closer to the front impedance matching layer) is coupled to the shield area 292 (as shown in FIG. 4) of the front metal layer 250 through front metal layer pad 287 and shield pad 285. The electrical connection between the front metal layer and the shield layers helps reduce noise from the front face of the transducer.

Figure 3:
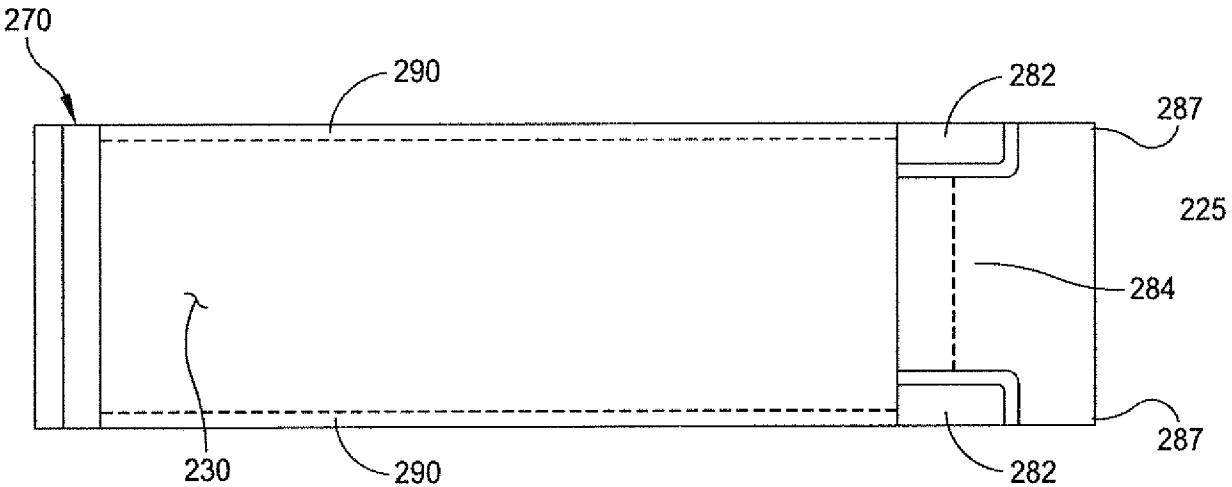
FIG. 3 is a plan view of the top of a front impedance converter of a transducer according to an embodiment of the invention in which the signal return and shield connection to the flex circuit is on the proximal end of the transducer.
Figure 4:
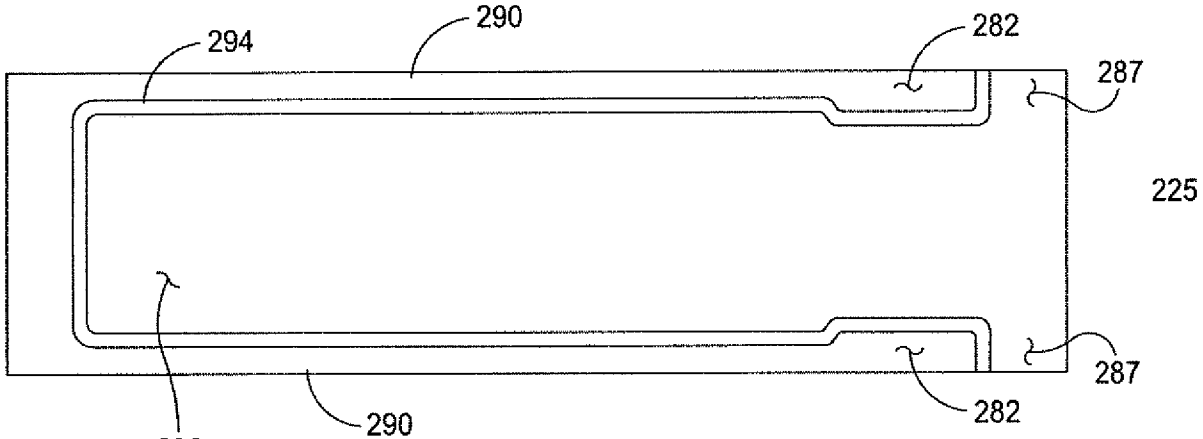
FIG. 4 is a plan view of the bottom of a front impedance converter of a transducer according to an embodiment of the invention in which the signal return and shield connection to the flex circuit is on the proximal end of the transducer.

FIG. 3 depicts a plan view of the "underside" of front impedance converter 225, the underside being the face of the converter that is coupled to the piezoelectric array 220. Front impedance converter 225 includes connection region 270 that is electrically coupled to conductive strip 275 (as shown on FIG. 2) on the piezoelectric array 220, and signal return pads 282 and shield pads 287. The signal return pads are electrically connected to the connection region 270 by strips 290 that are under the back polymer layer 230. As shown, the back polymer layer 230 may extend from the connection region 270 (but not cover the connection region) to signal return pads 282, such that the back polymer layer does not cover the signal return pads 282. The signal return pads 282 and shield pads 287 are areas on the underside of the front impedance converter 225 and are in contact with the signal return pads 280 and shield pads 285 of the rear layer 210. The use of the term "pads" does not necessarily imply a physical structure, although ACF or another conductive material or film may be applied to the pads to facilitate the electrical connections and the physical structure of the pad areas may be built-up or recessed as needed to ensure proper mating of the pads.

FIG. 4 depicts a plan view of the structural pattern of the metal layer in the front impedance converter 225, the top corresponding to the face of the front converter that is not adjacent to the piezoelectric array 220. Space 294 denotes an area in the front metal layer 250 where there is no copper. Thus, the front metal layer comprises two electrically isolated sections separated by space 294, the two sections being (1)

strips 290 that are electrically connected to the connection region 270 and the signal return pads 282, thus forming a signal return path, and (2) shield area 292 which is electrically connected to shield pads 287, the shield helping to reduce noise that might effect the transducer sensor signals. Incorporating the signal return path into the front impedance layer, and then including a connection region 270 to contact the individual elements of piezoelectric array 220 avoids much of the labor intensive work required to provide a return signal for a piezoelectric array as was previously done in the prior art.

Figure 5A:
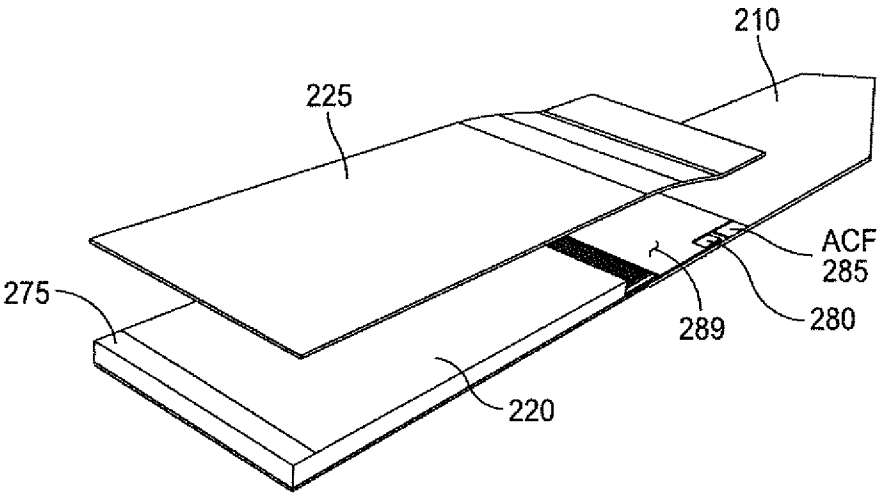
FIG. 5A is a perspective view from above a transducer according to an embodiment of the invention in which the signal return and shield connection to the flex circuit is on the proximal end of the transducer.
Figure 5B:
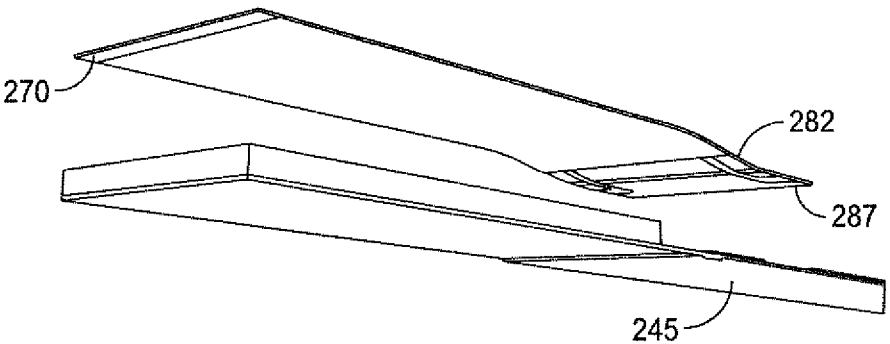
FIG. 5B is a perspective view of the underside of the front matching layer of a transducer according to an embodiment of the invention in which the signal return and shield connection to the flex circuit is on the proximal end of the transducer.

FIGS. 5A and 5B depict perspective views of a transducer according to an embodiment of the invention in which the signal return is in the front impedance matching layer and the signal return connection to the flex circuit is on the proximal end of the transducer. FIG. 5A shows piezoelectric array 220 and rear layer 210. Piezoelectric array 220 includes conductive strip 275. Shield pad 285 and return pad 280 on the back rear layer 210 are shown adjacent to polymer cover 289. FIG. 5B shows another perspective view in which the underside of the front impedance converter 225 is shown, and which includes connection region 270 that is in electrical contact with conductive strip 275 when the front impedance converter is joined to the piezoelectric array 220. FIG. 5B also shows the shield layer 245 under the proximal end of the rear layer. The shield layer connects to shield pad 285, and in the embodiment shown in FIG. 5B does not extend under the piezoelectric array 220. The perspective view of FIG. 5B also shows signal return pad areas 282 and shield connection pad areas 287. As will be understood, when the front impedance converter is bonded to the piezoelectric array 220, signal return pads 280 (on the rear layer) and 282 (on the front impedance converter) are electrically coupled and shield pads 287 (on the front impedance converter) and 285 (on the shielded portion of the flex circuit) are electrically coupled. FIG. 5A also shows insulator element 289, which may be an insulating film that is shaped to allow electrical contact between the shield pads and return pads of the front impedance layer and the rear layer. As noted, insulator element 289 prevents direct contact between the signal traces on flex circuit 235 and the extended shield area 292 of the front metal layer 250 except for in the shield pad and return pad areas.

A method for forming the ultrasonic transducer of FIGS. 2-5 may comprise the steps of: (1) providing a rear layer including a flex circuit layer; (2) disposing a first side of a piezoelectric element onto a first side of the flex circuit layer of the rear layer; (3) dicing the piezoelectric element to create a piezoelectric array; (4) disposing a front impedance matching layer onto a second side of the piezoelectric array, wherein the front impedance matching layer further includes a front metal layer having a connection region portion and a signal return portion; and (5) attaching a backing absorber layer to a second side of the flex circuit layer. Disposing the front impedance matching layer onto the second side of the piezoelectric array causes electrical coupling of the connection region portion of the front metal layer with the second side of the piezoelectric array; and electrical coupling of a proximal end of the signal return portion with a return signal line portion of the flex circuit, thereby completing a return circuit for the transducer. In the method for constructing a transducer, the front impedance matching layer may further comprise a front polymer layer adjacent to a first side of the front metal layer and a back polymer layer adjacent to a second side of the front metal layer, and wherein disposing the front impedance matching layer onto the piezoelectric array may comprise disposing the back polymer layer onto the second side of the piezoelectric array and thereby electrically coupling the connection region portion with the piezoelectric array. In an embodiment, the back polymer layer may be shorter than the front metal layer at a distal end of the transducer, thereby exposing the connection region portion for coupling to the piezoelectric array.

In the method for forming the transducer shown on FIGS. 2-5, the flex circuit may comprise a shielded portion at a proximal end of the transducer and a non-shielded portion at a distal end of the transducer, and disposing a first side of a piezoelectric array onto a first side of the flex circuit layer of the rear layer comprises disposing the piezoelectric array onto the non-shielded portion of the flex circuit. The front metal layer may further comprise a shield portion electrically isolated from the connection region portion and the signal return portion and the method may further comprise electrically coupling the shield portion of the front metal layer to the shielded portion of the flex circuit at the proximal end of the transducer. In other embodiment, electrically coupling the signal return portion of the front metal layer to the return signal portion of the flex circuit comprises disposing the front impedance matching layer on the piezoelectric array such that front metal layer signal return pads of the front metal layer are in electrical contact with rear layer signal return pads of the rear layer. Electrically coupling the shield portion of the front metal layer and the shielded portion of the flex circuit layer of the rear layer comprises disposing the front impedance matching layer on the piezoelectric array such that shield pads of the front metal layer are in electrical contact with rear layer shield pads of the shielded portion of the flex circuit layer.

In an embodiment, the back polymer layer is shorter than the front metal layer and the front polymer layer on a proximal end of the transducer, and the method for constructing the transducer includes disposing an insulator element between the front metal layer and the flex circuit for preventing unintended electrical coupling between the front metal layer and the flex circuit. In an embodiment, the method may further comprise disposing a conductive layer or material (such as a conductive film) between the piezoelectric array and the connection region for electrically coupling the piezoelectric array with the connection region. The method may also comprise coupling a backing absorber layer to a second side of the flex circuit layer.

Figure 6:
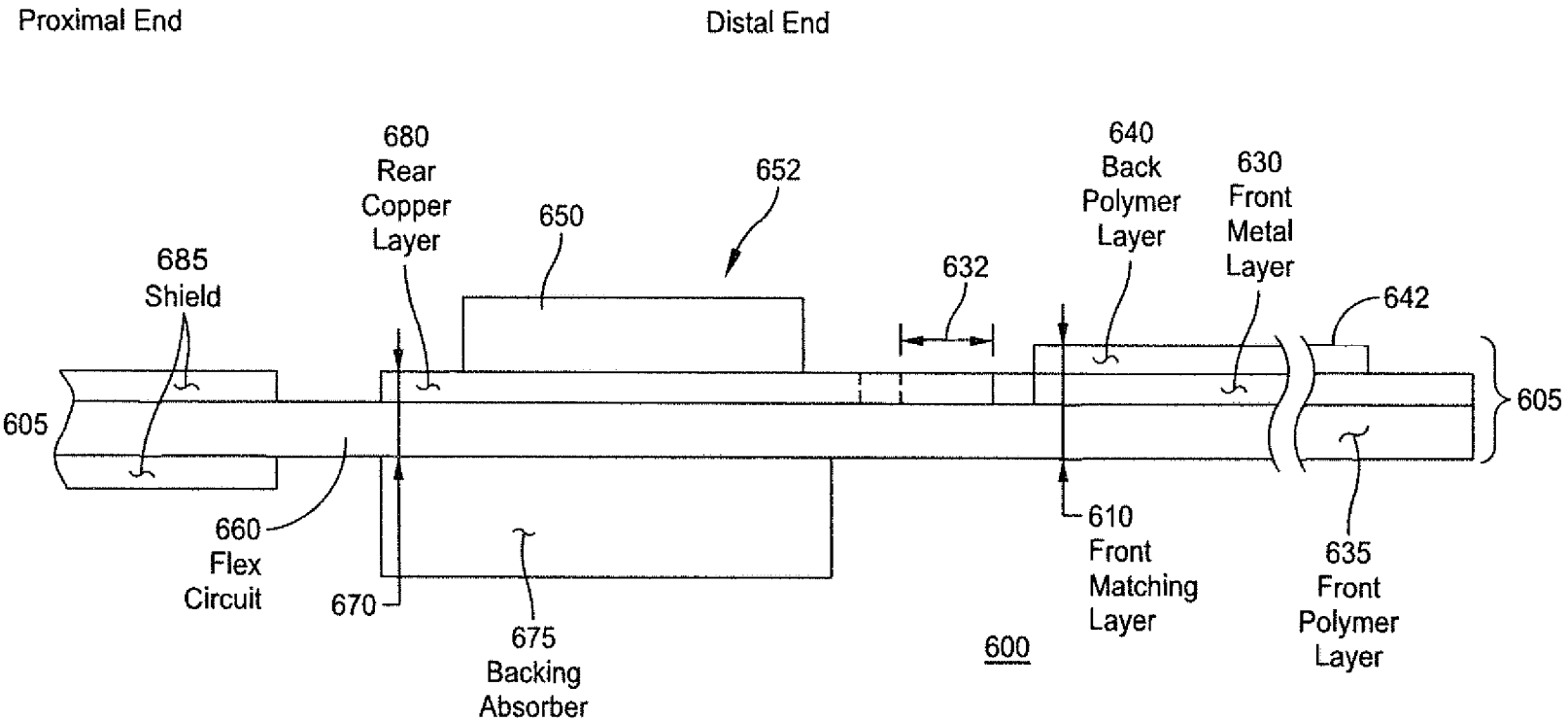
FIG. 6 is a side view of a transducer according to an embodiment of the invention in which the signal return connection to the flex circuit is on the distal end of the transducer.

FIG. 6 depicts a side view of a transducer 600. In this embodiment, a folding layer 605 is comprised of a contiguous front impedance converter portion and rear layer portion, and the transducer structure is formed when the front impedance converter portion is folded over the piezoelectric array. As will be described herein, this embodiment also differs from the embodiment of FIGS. 2-5 in that the return line for the piezoelectric array is located in the rear layer rather than in the front impedance converter. In addition, this embodiment differs in that the signal return connection to the flex circuit is on the distal end of the transducer after the front impedance converter has been folded onto the piezoelectric array.

Specifically, the transducer 600 of FIG. 6 includes front matching layer 610 which includes flex circuit 660, front metal layer 630, and back polymer layer 640. As shown on FIG. 2 and discussed herein, the flex circuit has both copper and polymer components, though for impedance matching purposes the flex circuit acts as a polymer layer. The result is that in the embodiment of FIG. 6, construction of the transducer is simplified because the flex circuit 660 may act as a polymer layer for both the front matching layer and rear layer. The rear layer 670 includes rear copper layer 680 and flex circuit layer 660 (which acts as a polymer layer for impedance matching purposes). A backing absorber layer 675 may be coupled to the rear layer 670. Rear copper layer includes a connection region "handle" portion 632 that is electrically coupled to signal return lines formed on rear copper layer 680. As will be understood, a piezoelectric element is disposed on rear copper layer 680, and then the piezoelectric element is diced to form a piezoelectric array 650. The depth of the dicing is configured to also dice rear copper layer 680, which results in rear copper layer 680 having individual copper strips that align with the piezoelectric array elements and the circuit lines in the flex circuit 660. The copper strips on the side edges of rear copper layer 680 are underneath side guards of piezoelectric array 650, and are used as the return lines that are connected to connection region handle portion 632 at the distal end of the transducer and connected to the signal return lines on the flex circuit at the proximal end of the transducer. As will be understood, when the front matching layer 610 is folded over piezoelectric array 650, face 642 of back polymer layer 640 is brought in contact with the face 652 of piezoelectric array 650. As a result, portion 632 of rear copper layer 680 is brought into contact with the elements of face 652 of piezoelectric array 650 and acts as the return path for the signals applied to the piezoelectric array elements by the flex circuit 660. A conductive material (e.g. a film or a conductive layer) such as ACF may be used to form the connection between copper connection region handle 632 and the elements on piezoelectric array 650.

As will be understood, the electrical lines of the flex circuit layer 660 need to be electrically connected to the elements of the piezoelectric array. Backside electrodes (not shown) of the piezoelectric array 650 are connected to conductive traces of the flex circuit layer 660. From a technical standpoint, the flex circuit layer 660 need not extend beyond the distal end of piezoelectric array 650. From a practical standpoint, however, the flex circuit layer may be extended beyond the distal end of the piezoelectric array 650 and through the front impedance matching layer 610, with the flex circuit acting as a polymer layer in the front impedance matching layer 610. Using the flex circuit as a polymer layer in the front impedance matching layer simplifies the construction of the transducer by eliminating the need for a separate front polymer layer in the front impedance matching layer, and also eliminates the need to line up connection points between the flex circuit and a front polymer layer.

Figure 7A:
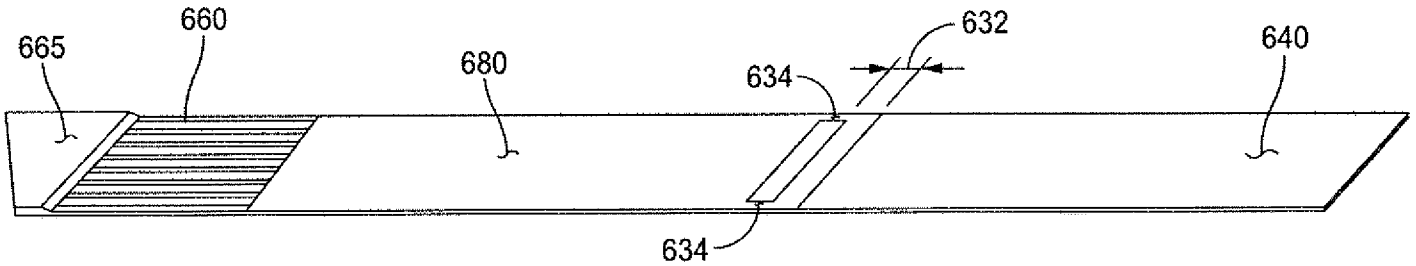
FIG. 7A is a perspective view of the folding layer with rear copper layer connection region portion according to an embodiment of the invention in which the signal return connection to the flex circuit is on the distal end of the transducer.
Figure 7B:
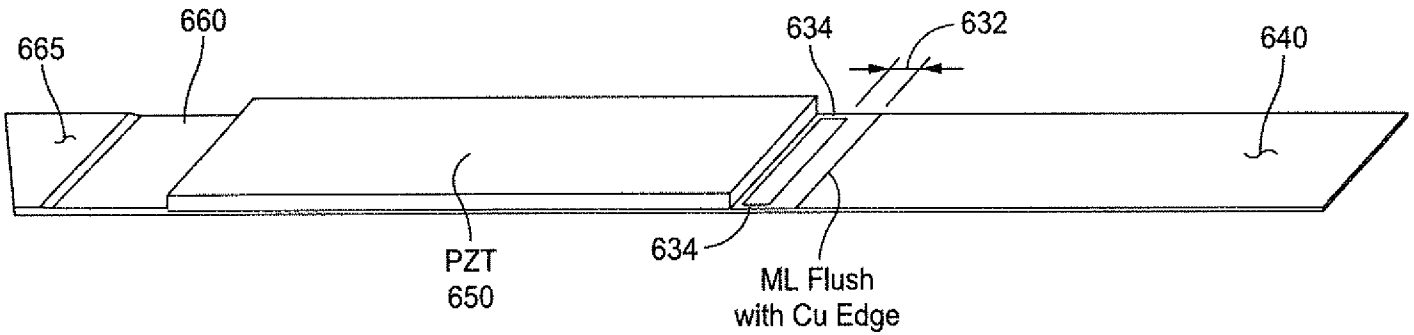
FIG. 7B is a perspective view of the connection region and piezoelectric array elements bonded on the rear flex layer of a transducer according to an embodiment of the invention in which the signal return connection to the flex circuit is on the distal end of the transducer.

FIGS. 7A and 7B provide a perspective view of a connection region "handle" that may be formed to act as a signal return for the piezoelectric array elements. A conductive layer such as copper is applied to the flex circuit layer of the front impedance converter such that a connection region is formed on the polymer layer. The copper layer 680, together with the flex circuit layer 660, act as a rear layer 670. In addition, copper layer 680 includes a main portion area 636, conductive sidebars 634, and connection region handle area 632. As shown on FIG. 7B, the connection region handle area 632 may be formed between the distal end of the piezoelectric array 650 and the back polymer layer 640 of the front matching layer 610. Conductive sidebars 634 are also formed are part of the copper layer 680. When the piezoelectric element 650 is diced, copper strips are formed in the main portion area 636 (shown in part in FIG. 8) that correspond to individual elements of the piezoelectric array 650. In addition, the dicing results in strips on the edges or sides of the main area of the copper layer 680 that align with, and are electrically connected to, the conductive sidebars 634. The edge strips are also electrically connected to signal return lines of the flex circuit by known methods, thus forming a signal return path from the flex circuit signal lines to the edge strips to the conductive sidebars 634 to the connection region area 632. As will be understood, the area between the conductive sidebars 634 does not have copper so that when the front impedance matching layer is folded, the end of the piezoelectric array 650 does not make electrical contact with the signal return copper of the connection region handle and the sidebars. Thus, when front matching layer 610 is folded over piezoelectric array 650, connection region area 632 is in contact with the top of piezoelectric array 650 and acts as a common signal return for the piezoelectric array elements. FIG. 7B shows a perspective view of the piezoelectric element 650 mounted on the main portion of the a connection region "handle"

Figure 8:
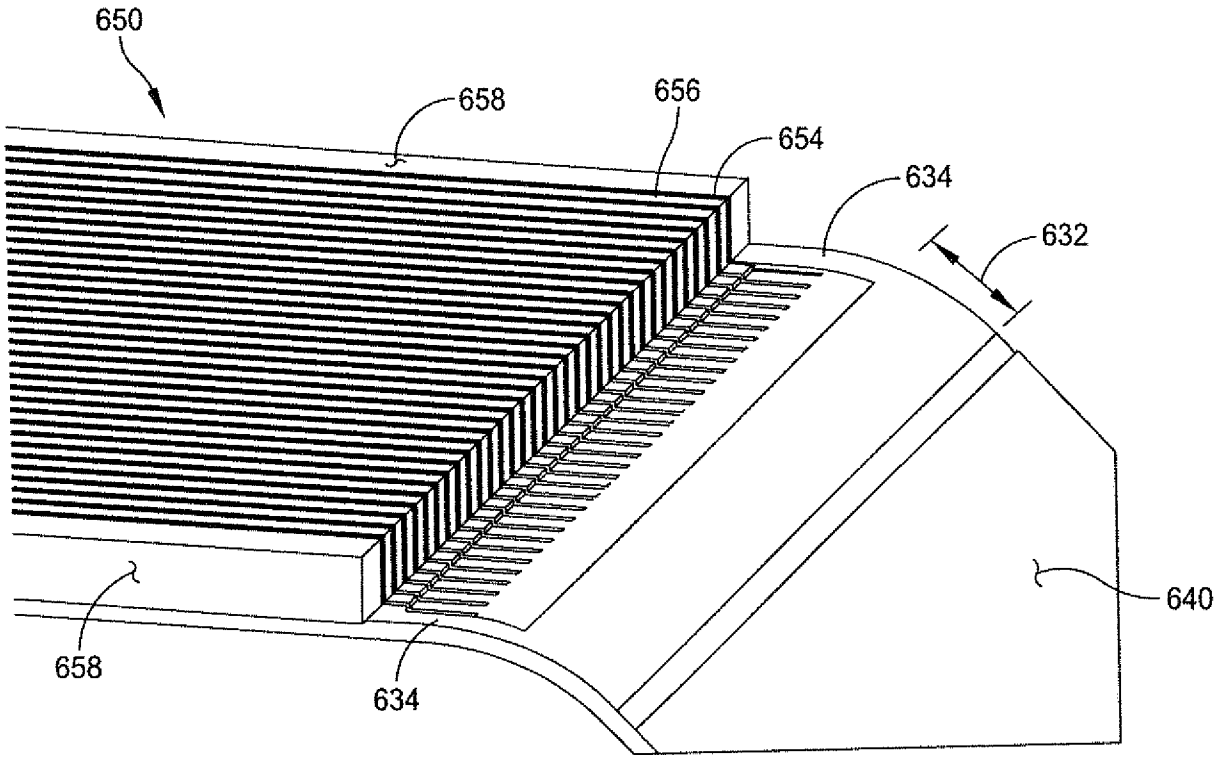
FIG. 8 is a detailed perspective view of the piezoelectric array and connection region "handle" on the rear flex circuit layer according to an embodiment of the invention in which the signal return connection to the flex circuit is on the distal end of the transducer.

FIG. 8 is a detailed perspective view of the connection region handle and piezoelectric array elements according to an embodiment of the invention in which the signal return connection to the flex circuit is on the distal end of the transducer. As shown in FIG. 8, piezoelectric element 650 is diced and includes individual piezoelectric array elements 656 and kerfs 654. The kerfs 654 are filled with polymer as is known in the art. The dicing of the piezoelectric element is configured to penetrate the rear copper layer 680 so that individual copper strips are formed that coincide with the individual piezoelectric array elements and the flex circuit lines, thus electrically isolating each of the lines from each other. An end of each of the copper strips is electrically connected to the individual electrical lines of the flex circuit 660. The conductive sidebars 634 are signal return paths formed as part of copper layer 680, and which are electrically coupled to the connection region handle 632 and to the copper strips that are formed under side guard elements 658 of the piezoelectric array (on the side edges of the piezoelectric array), when the array is diced. As also shown in FIG. 8, the front matching layer 610 (with back polymer layer 640) may be folded back when the dicing operation is performed to prevent the front matching layer from being diced during the process.

Figure 9:
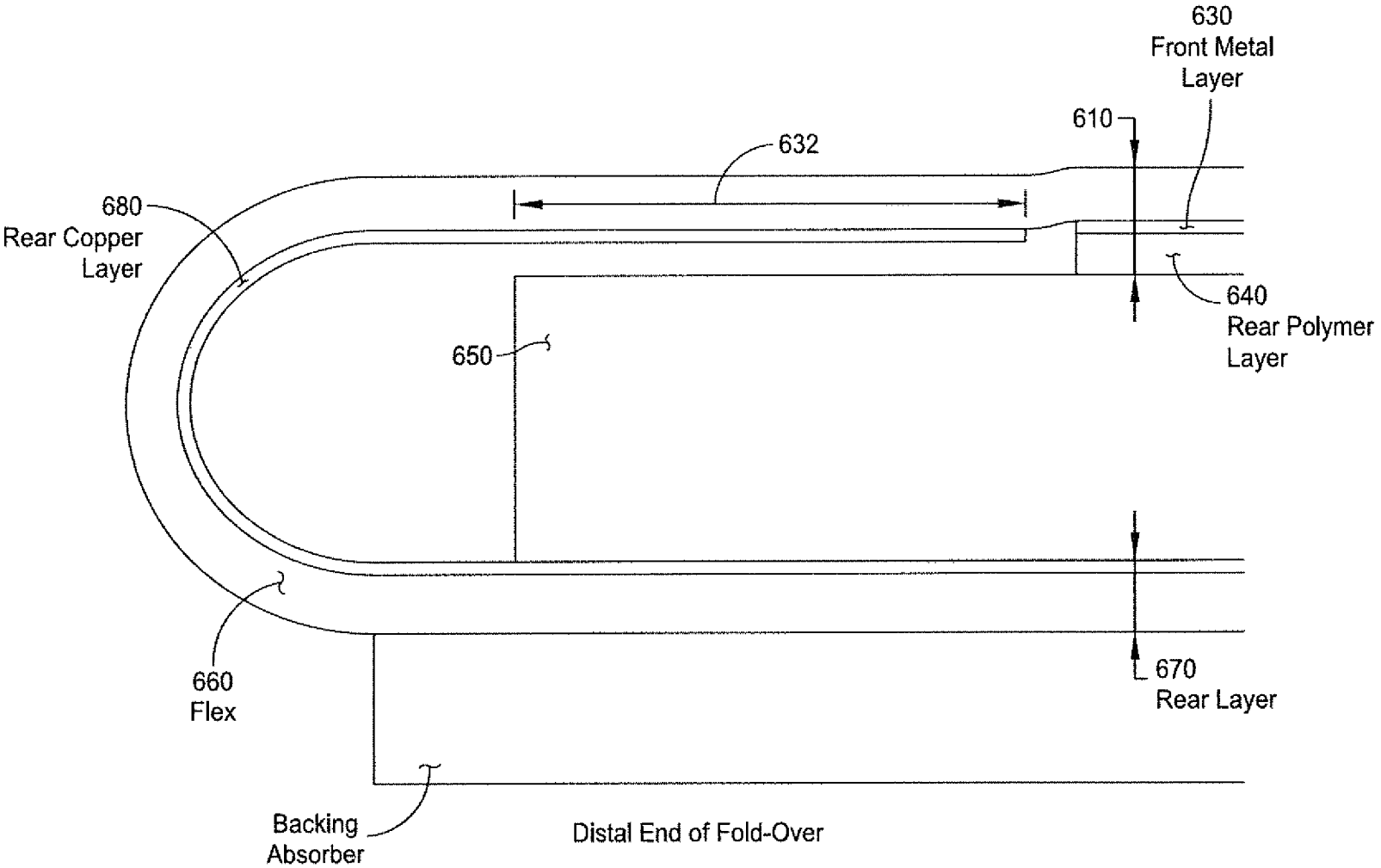
FIG. 9 is a side view of a distal end of the transducer with front matching layer folded onto the piezoelectric array according to an embodiment of the invention in which the signal return connection to the flex circuit is on the distal end of the transducer.

FIG. 9 is a side view of a distal end of a transducer according to an embodiment of the invention in which the signal return connection to the flex circuit is on the distal end of the transducer. More specifically, FIG. 9 shows the distal end of the transducer and the relation between the front matching layer 610 and the piezoelectric array 650 after folding. As shown, folding places the connection region handle area 632 formed in rear copper layer 680 in contact with piezoelectric array 650, thus creating a signal return for each of the individual piezoelectric elements in the array. In an embodiment, the connection region handle 632 may be placed in direct contact with the piezoelectric array 650. In another embodiment, ACF may be placed between the connection region handle and the array. In addition, as shown, folding may result in a cavity being formed between the end of piezoelectric array 650 and the folded end of front matching layer 610. That cavity may be backfilled with nonconductive filler to increase the strength of the structure. Also shown in FIG. 9 is front impedance matching layer 610. In the embodiment shown, the front polymer layer 635 (as shown on FIG. 6) of the front impedance matching layer 610 is comprised of the flex circuit layer 660 of the rear layer 670. As discussed herein, the flex circuit layer has the acoustic properties of a polymer layer, so it may be substituted for a polymer layer in the transducer. The use of the flex layer for the front polymer layer 635 greatly simplifies the construction of the transducer by allowing the flex layer to used continuously through the folding or folded layer that is comprised of the front impedance matching layer 610 and the rear layer 670.

Figure 10:
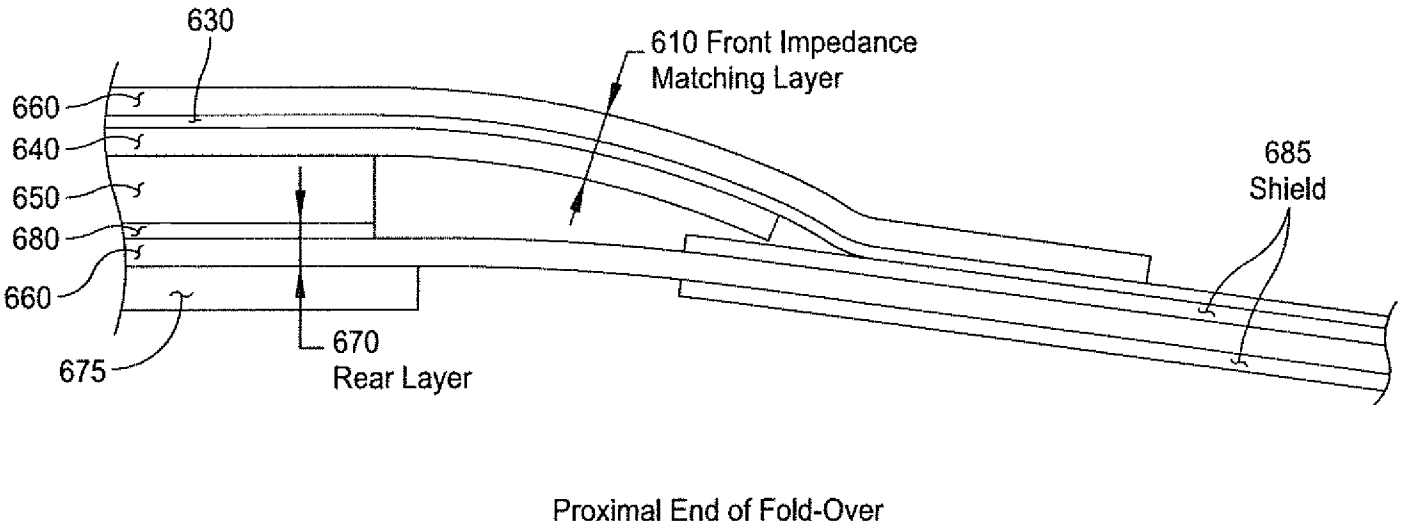
FIG. 10 is a side view of a proximal end of a transducer with front matching layer folded onto the piezoelectric array according to an embodiment of the invention in which the signal return connection to the flex circuit is on the distal end of the transducer.

FIG. 10 is a side view of the proximal end of the transducer of FIG. 6. in an embodiment As shown in the side view, the front impedance matching layer 610, after it is folded over the piezoelectric array 650, extends beyond the proximal end of the piezoelectric array and onto the top of the flex circuit layer 660. This overlap of the front matching layer and the flex circuit layer on the proximal end allows the front metal layer 630 of the front impedance matching layer 610 to be electrically connected to shield layers 685 of the rear layer. In an embodiment the flex circuit layer 660 includes shield layers 685 above and below the flex circuit layer 660 at the proximal end of the transducer. The flex circuit layer 660 may have copper pads on its top and bottom surfaces that are electrically connected by known methods and that form an electrical connection between the shield layers 685. In addition, the top shield layer 685 is in physical contact with the front metal layer 630, thus creating an electrical connection between the front metal layer 630 and the shield 685. The connection between the top shield layer 685 and the front metal layer 630 may be may be made by bonding, using ACF, or other known methods, and in an embodiment the back polymer layer 640 is shorter than the front metal layer 630 at the proximal end of the transducer, which brings the front metal layer 630 into contact with the shield layer when the front matching layer is folded onto the rear layer on the proximal end of the transducer. The electrical connection between the front metal layer and the shield layer helps reduce noise from the front face of the transducer.

The transducer of FIGS. 6-10 may be constructed by providing a folding layer including a rear layer portion comprising a rear copper layer including a main portion, a connection region portion, and signal return lines and a flex circuit layer including flex signal return lines coupled to the rear copper layer; and a front impedance matching layer portion. After the folding layer is provided, a first side of a piezoelectric element is disposed onto the main portion of the rear copper layer. Then the piezoelectric element is diced, thereby creating a piezoelectric array. The dicing is configured to also penetrate the main portion of the rear copper layer beneath the piezoelectric array, thereby forming individual copper signal lines or strips that correspond to piezoelectric array elements and also forming signal return line strips, the signal return line strips being electrically connected to the connection region portion and to the flex signal return lines. Then the front impedance matching layer portion and the connection region portion of the folding layer are folded onto the piezoelectric array, which results in the front impedance matching layer portion and the connection region portion being coupled to the piezoelectric array. This creates a signal return path for the piezoelectric array via the connection region and the signal return lines electrically connected to the flex layer signal return lines.

In the method for constructing the transducer of FIGS. 6-10, the flex circuit layer may include a shielded portion and a non-shielded portion. In this embodiment, the rear copper layer is adjacent or coupled to the non-shielded portion of the flex circuit layer. A front metal layer of the front impedance matching layer may be electrically coupled to shielded portion of the flex circuit at a proximal end of the ultrasonic transducer. The front impedance matching layer may further comprise a front polymer layer adjacent to a first side of the front metal layer and a back polymer layer adjacent to a second side of the front metal layer. In this embodiment, folding the front impedance matching layer portion onto a second side of the piezoelectric element comprises folding the back polymer layer onto the second side of the piezoelectric element. The embodiment may also comprise shortening the back polymer layer so that it is shorter than the front metal layer and the front polymer layer, thereby exposing the front metal layer for electrical coupling to the shielded portion of the flex circuit. In an embodiment, the front polymer layer of the front impedance matching layer may be comprised of the flex circuit layer of the rear layer. The method for constructing the transducer may also comprise applying a conductive epoxy such as silver epoxy to the back polymer layer of the front impedance matching layer before folding, thereby causing the front impedance matching layer to bond to the piezoelectric array after folding. Silver epoxy may also be applied to the connection region of the front impedance matching layer portion before folding, thereby causing the connection region to bond to the piezoelectric array after folding. In an embodiment, before dicing the piezoelectric element, the front impedance matching layer portion may be bent downward so that it is below the planar surface formed by the rear layer portion of the folding layer, thereby preventing the front impedance matching layer portion 610 or the connection region handle area 632 portion from being diced.

Variations and modifications to the disclosed embodiments are within the scope of the invention. For example, while the piezoelectric units are generally shown as relatively thin and flat layers, other shapes and forms may be employed. Surfaces that are disclosed as being on and in contact with one another may have interposed therebetween thin layers of materials such as adhesives having little or no effect on the acoustic impedance of the structure.

While the foregoing invention has been described with reference to the above embodiments, various modifications and changes can be made without departing from the spirit of the invention. Accordingly, all such modifications and changes are considered to be within the scope of the appended claims.

What is claimed is:

1. An ultrasonic transducer comprising:

a rear layer including a flex circuit layer;

a piezoelectric element coupled on a first side to the flex circuit layer;

a front impedance matching layer including a front metal layer comprising a connection region portion at a distal end of the ultrasonic transducer and a signal return portion electrically coupled to the connection region portion and extending from the distal end to a proximal end of the ultrasonic transducer; and wherein the front impedance matching layer is coupled to a second side of the piezoelectric element, thereby causing the connection region portion of the front metal layer to make electrical contact with the piezoelectric element; and wherein a proximal end of the signal return portion of the front metal layer is electrically coupled to a signal return conductor of the flex circuit layer at the proximal end of the ultrasonic transducer, thereby completing a return circuit.

2. The ultrasonic transducer of claim 1, wherein:

the front impedance matching layer further comprises a front polymer layer adjacent to a first side of the front metal layer and a back polymer layer adjacent to a second side of the front metal layer, wherein the back polymer layer is also coupled to the second side of the piezoelectric element.

3. The ultrasonic transducer of claim 2, wherein the back polymer layer is shorter than the front metal layer at the distal end of the ultrasonic transducer, thereby exposing the connection region portion for coupling to the piezoelectric element.

4. The ultrasonic transducer of claim 1, wherein the flex circuit layer comprises a shielded portion at the proximal end of the ultrasonic transducer and a non-shielded portion at the distal end of the ultrasonic transducer;

wherein the piezoelectric element is coupled to the non-shielded portion of the flex circuit layer;

wherein the front metal layer further comprises a shield portion electrically isolated from the connection region portion and the signal return portion, and wherein the shield portion of the front metal layer is electrically coupled to the shielded portion of the flex circuit layer at the proximal end of the ultrasonic transducer.

5. The ultrasonic transducer of claim 4, wherein the front metal layer further comprises front metal layer signal return pads and front metal layer shield pads at the proximal end of the ultrasonic transducer;

the shielded portion of the flex circuit layer further comprises shield layer pads at the proximal end of the ultrasonic transducer; and the flex circuit layer of the rear layer further comprises flex circuit layer signal return pads at the proximal end of the ultrasonic transducer;

wherein said signal return portion of the front metal layer is electrically coupled to the signal return conductor of the flex circuit layer via the front metal layer signal return pads and the flex circuit layer signal return pads; and wherein said shield portion of the front metal layer is electrically coupled to the shielded portion of the flex circuit layer via the front metal layer shield pads and the shield layer pads.

6. The ultrasonic transducer of claim 2, wherein the back polymer layer is shorter than the front metal layer and the front polymer layer on the proximal end of the ultrasonic transducer, and further comprising an insulator element between the front metal layer and the flex circuit layer for preventing unintended electrical coupling between the front metal layer and the flex circuit layer.

7. The ultrasonic transducer of claim 1, further comprising a conductive layer between the piezoelectric element and the connection region portion for electrically coupling the piezoelectric element with the connection region portion.

8. The ultrasonic transducer of claim 1, further comprising a backing absorber layer coupled to a second side of the flex circuit layer.

9. The ultrasonic transducer of claim 1, wherein the signal return portion of the front metal layer comprises at least two metal strips extending from the connection region portion of the front metal layer to corresponding front metal layer signal return pads of the front metal layer at the proximal end of the ultrasonic transducer.

10. The ultrasonic transducer of claim 9, wherein the at least two metal strips are on outer edges of the signal return portion of the front metal layer.

11. The ultrasonic transducer of claim 1, further comprising a metal layer between the flex circuit and the backing absorber.

12. The ultrasonic transducer of claim 1, wherein the flex circuit layer comprises a shielded portion extending from the distal end to the proximal end of the flex circuit layer, and wherein the piezoelectric element is coupled to the shielded portion of the flex circuit layer.

13. An ultrasonic transducer comprising:

a piezoelectric element;

a folded layer comprising a rear layer portion including a flex circuit layer and a rear copper layer adjacent to a first side of the flex circuit layer, the rear copper layer having a signal lines portion, a connection region portion, and signal return lines; and a front impedance matching layer portion;

wherein the front impedance matching layer portion and the connection region portion of the rear copper layer are coupled to a first side of the piezoelectric element;

wherein the signal lines portion of the rear copper layer of the rear layer portion are coupled to the second side of the piezoelectric element; and wherein the signal return lines of the rear copper layer electrically couple the connection region portion to signal return conductors of the flex circuit layer, thereby creating a piezoelectric element signal return.

14. The ultrasonic transducer of claim 13, wherein the flex circuit layer includes a shielded portion and a non-shielded portion and the rear copper layer is adjacent to the non-shielded portion of the flex circuit layer, and wherein a front metal layer of the front impedance matching layer portion is electrically coupled to the shielded portion of the flex circuit layer at a proximal end of the ultrasonic transducer.

15. The ultrasonic transducer of claim 14, wherein the front impedance matching layer portion further comprises a front polymer layer adjacent to a first side of the front metal layer and a back polymer layer adjacent to a second side of the front metal layer, and wherein the front impedance matching layer portion being coupled to the first side of the piezoelectric element comprises the back polymer layer being coupled to the first side of the piezoelectric element.

16. The ultrasonic transducer of claim 15, wherein the back polymer layer is shorter than the front metal layer and the front polymer layer, thereby exposing the front metal layer for electrical coupling to the shielded portion of the flex circuit layer.

17. The ultrasonic transducer of claim 15, wherein the front polymer layer is comprised of the flex circuit layer of the rear layer portion.

18. The ultrasonic transducer of claim 13, further comprising conductive layer between the second side of the piezoelectric element and the connection region portion for electrically coupling the piezoelectric element with the connection region portion.

19. The ultrasonic transducer of claim 13, wherein the signal lines portion of the rear copper layer is offset from the connection region portion of the rear copper layer and the signal return lines are on outer edges of the rear copper layer, thereby forming an opening in the rear copper layer, the opening being collocated with a distal end of the piezoelectric element and preventing the rear copper layer from making unintended electrical contact with the piezoelectric element.

20. The ultrasonic transducer of claim 13, further comprising a backing absorber layer coupled to a second side of the flex circuit layer.

* * * * *